US005794634A

United States Patent [19]

Noren et al.

[11] Patent Number: 5,794,634

[45] Date of Patent: Aug. 18, 1998

[54] WAREWASHER TANK HEATING SYSTEM AND CONTROLS THEREFOR

[75] Inventors: Lars Noren; Doug Noren, both of Petaluma, Calif.

[73] Assignee: Premark FEG L.L.C., Wilmington, Del.

[21] Appl. No.: 883,239

[22] Filed: Jun. 26, 1997

Related U.S. Application Data

[63] Continuation of Ser. No. 607,091, Feb. 28, 1996, Pat. No. 5,642,742, which is a continuation-in-part of Ser. No. 322,929, Oct. 13, 1994, Pat. No. 5,511,570.

[51] Int. Cl.[6] ..... B08B 3/10

[52] U.S. Cl. ..... 134/57 D; 134/106; 134/108; 134/105

[58] Field of Search ..... 134/57 D, 106, 134/111, 56 R, 56 D, 57 R, 58 R, 58 D, 105, 108; 105/904, 148; 122/42, 43, 95.1; 235/32, 266

[56] References Cited

U.S. PATENT DOCUMENTS

| | | | |
|---|---|---|---|
| 1,624,982 | 4/1927 | Rosenberg . | |
| 1,896,648 | 2/1933 | Thomas . | |
| 2,395,968 | 5/1946 | Hiort | 134/56 |
| 2,483,709 | 4/1949 | Paulsen | 18/6 |
| 2,614,571 | 10/1952 | Turpin | 134/61 |
| 2,674,550 | 4/1954 | Dunlevy et al. | 134/3 |
| 2,747,590 | 5/1956 | Ipsen | 134/105 |
| 3,407,025 | 10/1968 | Hardison | 431/329 |
| 3,440,299 | 4/1969 | Woskow et al. | 260/680 |
| 3,571,939 | 3/1971 | Paul | 34/1 |
| 3,625,233 | 12/1971 | Southard | 134/165 |
| 3,773,520 | 11/1973 | Longenecker et al. | 426/502 |
| 3,844,299 | 10/1974 | Athey et al. | 134/57 D |
| 3,846,615 | 11/1974 | Athey et al. | 219/333 |
| 3,915,180 | 10/1975 | Jacobs | 134/58 D |
| 3,982,552 | 9/1976 | Fraula | 134/57 D |
| 4,159,211 | 6/1979 | Hoffman et al. | 134/57 D |
| 4,439,242 | 3/1984 | Hadden | 134/25.2 |
| 4,492,185 | 1/1985 | Kendall et al. | 122/32 |
| 4,510,890 | 4/1985 | Cowan | 122/17 |
| 4,519,770 | 5/1985 | Kesselring et al. | 431/7 |
| 4,597,734 | 7/1986 | McCausland et al. | 431/328 |
| 4,810,306 | 3/1989 | Noren | 134/25.2 |
| 4,895,137 | 1/1990 | Jones et al. | 126/391 |
| 4,993,402 | 2/1991 | Ripka | 126/361 |
| 5,137,041 | 8/1992 | Hall | 134/57 D |
| 5,201,807 | 4/1993 | Liljenberg et al. | 122/18 |
| 5,253,566 | 10/1993 | McCabe et al. | 99/403 |
| 5,317,992 | 6/1994 | Joyce | 122/14 |
| 5,375,563 | 12/1994 | Khinkis et al. | 122/4 D |
| 5,511,570 | 4/1996 | Noren et al. | 134/105 |
| 5,642,742 | 7/1997 | Noren et al. | 134/57 D |

*Primary Examiner*—Frankie L. Stinson
*Attorney, Agent, or Firm*—Thompson Hine & Flory LLP

[57] ABSTRACT

The invention includes a warewasher comprising a wash chamber, a tank at the bottom of said chamber for supplying recirculated heated water through a pump to wash arms in said chamber, a primary water heating system comprising a heat exchange tube entering said tank through a first port or inlet in said tank, traversing the base of the tank, and exiting said tank through a second port or outlet, said tube being at a height in said tank such that the tube is submerged when said tank is filled with water, said tube having a first end and a second end located outside of the tank and providing a passageway between the ends, a gas-fired infrared burner located in said tube adjacent said first end to which an air/gas mixture is supplied and combusted by said burner, at least one secondary labyrinthine heat exchanger in intimate heat transfer relationship with at least one of the walls of said tank below the water level, and controls for automatically operating the heating system in response to a need to increase the tank water temperature, the combustion products of said burner being passed through said tube and secondary heat exchanger wherein, by combusting fuel with an infrared burner to minimize air pollution and by utilizing heat exchangers in the manner discussed herein, maximum heat transfer with minimal air pollution are achieved.

21 Claims, 4 Drawing Sheets

WAREWASHER TANK HEATING SYSTEM AND CONTROLS THEREFOR

This is a CONTINUATION of application Ser. No. 08/607,091, filed Feb. 28, 1996, which will issue as U.S. Pat. No. 5,642,742, which in turn is a continuation-in-part of U.S. application Ser. No. 08/322,929 filed Oct. 13, 1994, now U.S. Pat. No. 5,511,570.

This invention relates to a commercial warewasher and more particularly to a water heating system which includes a primary heat exchange tube having a gas-fired infrared (IR) burner therein immersed in a tank, in combination with additional baffle box type heat exchanger means in intimate contact with one or more sheet metal walls of the tank.

BACKGROUND OF THE INVENTION

Commercial warewashers vary significantly in their design and manner of use, but all include an open-topped water-containing tank. The design is frequently dictated by the kitchen environment in which the warewasher is used and the volume of ware to be washed. Typically, the tank has pre-heated water recirculated through wash arms under pressure from a pump. To do an effective washing job, the water temperature must be maintained at an approximate temperature of about 150 degrees F. in a high-temperature machine (one using a fresh final rinse at 180–195 degrees F.) or at about 140 degrees F. in a low-temperature machine (one utilizing a final rinse mixture of fresh water and sodium hypochlorite for sanitizing, also at about 140 degrees F.).

Industry has taken a number of different approaches in seeking the most cost-effective, energy-efficient type of warewasher, consisting of electricity, steam and gas in descending order of sales volume. The most common usage is of electrical heating elements immersed in the tank water, for two primary reasons. First and most important is the ease of installation for the end user. Electrical outlets are commonly available in a commercial food establishments, thus the unit can be merely plugged in and operated upon delivery. Secondly, electricity is essentially one hundred percent thermally efficient, because the elements are totally immersed in the tank water. Cost of operation is electricity's primary disadvantage, however, since a warewasher is used mainly during and just after mealtimes, when the larger electrical load during peak demand for electricity dictates higher utility rates to the end user. Another disadvantage is that electrical units are also slower in response time than gas.

While the cost rate of gas remains constant and is lower priced than electricity for the amount of energy provided, gas usage has nevertheless made little headway in the warewasher industry. One reason-is the need to install gas lines to the warewasher. Even though gas may be available in a kitchen, it is far easier to plug in an electrical unit than install additional gas piping for a new piece of equipment which operates on gas. Much more importantly, however, is the fact that the typical blue flame gas-fired warewashers of the past have been relatively inefficient. The burners were placed below the wash or rinse tank and the flame would function much like heating a pot over a stove, where energy is lost around the pot and escapes up a vent with combustion products which are somewhat air-polluting. Many such gas-fired warewashers, which represent as little as five percent of total warewashers sales of our assignee, have a heat transfer efficiency as low as fifty percent. This necessitates that burners with higher BTU (British Thermal Unit) ratings than is required to get effective heat transfer be used, since so many BTU's are lost to vent, tending to pollute the atmosphere as well. Thus, the lower-price, constant gas rates are, in effect, more than offset by the waste which occurs with such conventional gas-heated warewashers, due to the very low efficiency of conventional blue flame gas heating.

SUMMARY OF THE INVENTION

The present invention provides a new approach to decreasing the energy consumption of a commercial warewasher, thereby reducing annual operating costs to as little as one third of the annual cost for a similar machine operated electrically to heat the wash or rinse water. It also enables use of a more efficient fuel as the energy source, a fuel which has a constant cost rate at any time of day rather than a cost rate which increases at peak demand times of the day as does electricity.

One manifestation of the invention is a warewasher comprising a wash chamber, a tank at the bottom of the chamber for supplying heated water through a recirculating pump to wash arms in the chamber, a primary heating system comprising a heat exchange tube entering said tank through a first port or inlet in said tank, traversing the base of the tank, and exiting said tank through a second port or outlet, said tube being at a height in said tank such that the tube is submerged when said tank is filled with water, said tube providing a passageway for air/gas and combustion products between the inlet and outlet, a gas-fired IR burner located in said tube adjacent said first end to which an air/gas mixture is supplied and combusted by said burner, at least one secondary labyrinthine heat exchanger in intimate heat transfer relationship with at least one of the walls of said tank, and controls for automatically operating the heating system in response to a call for increasing the tank water temperature, the combustion products of the burner being passed through said tube and secondary heat exchanger wherein, by combusting fuel with an IR burner and utilizing heat exchangers in the manner discussed herein, maximum, highly-efficient heat transfer and low air pollution are achieved.

A principal object of the invention is to provide a higher efficiency, lower operating cost, lower polluting heating system for a warewasher than known heretofore.

Other objects will become apparent from the following description, in which reference is made to the accompanying drawings.

DESCRIPTION OF THE PREFERRED EMBODIMENT

Figure 2:
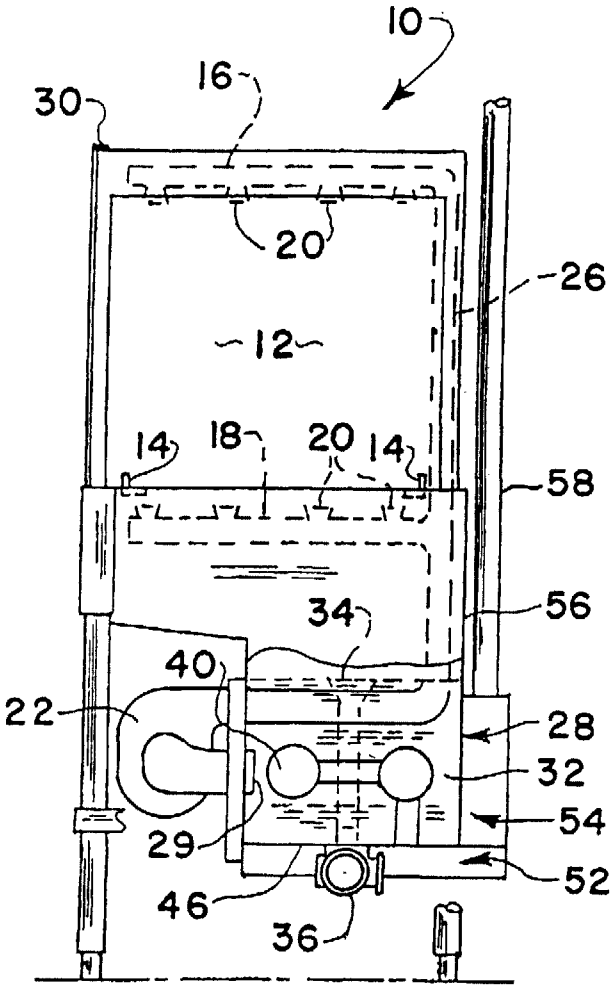
FIG. 2 is a right side fragmentary view of the warewasher of FIG. 1, looking in the direction of the arrow 2.
Figure 1:
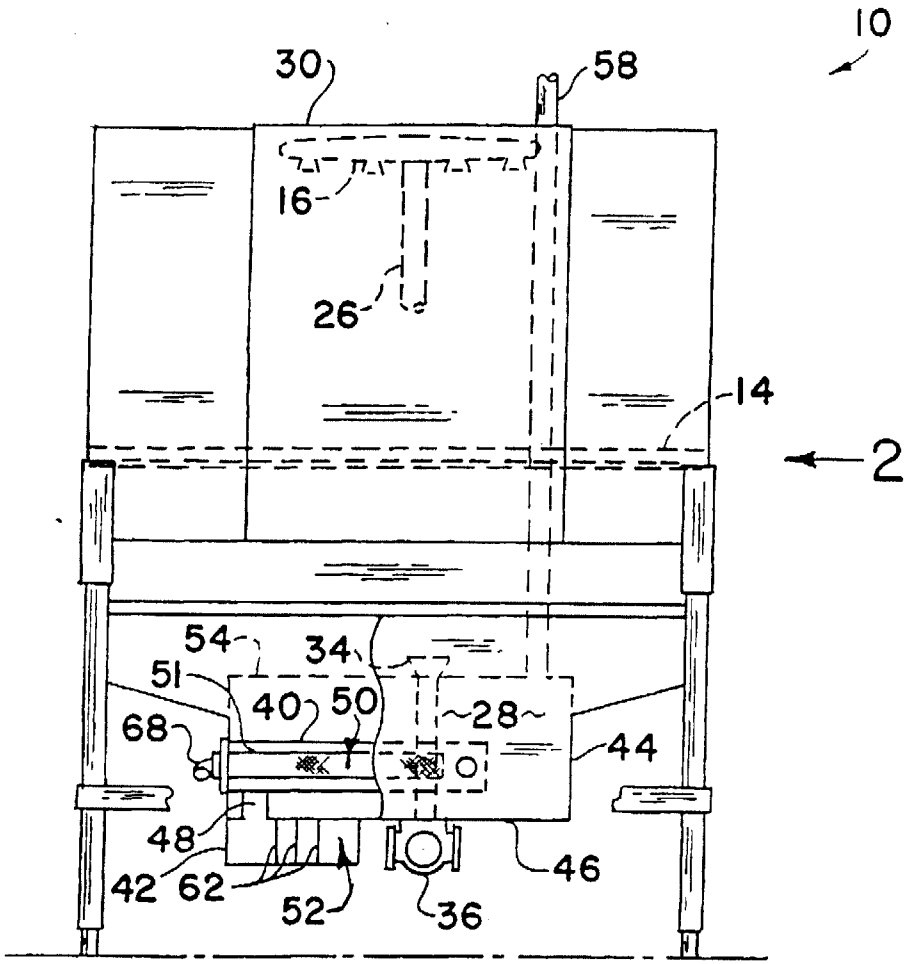
FIG. 1 is a partly-fragmentary simplified front elevational view of one type of warewasher with which the novel heating system of the invention may be utilized.

FIGS. 1 and 2 are front and right side views respectively of a warewasher of the type commonly referred to as a rack conveyor washer. This unit is shown for illustrative purposes only, it being understood that the invention is useful with any kind of tank-type warewasher or dishwasher where detergent-laden water or tank rinse water is recirculated by a pump through wash arms which spray the liquid onto the ware to be cleaned, after which the water drains back into the open-topped tank. The term tank as used herein applies equally to a rinse tank in which water which has previously been used as a fresh water rinse is contained in a separate heated tank and the ware given a pumped pre-rinse prior to a final fresh water rinse.

As viewed in FIG. 2, the warewasher 10 encloses a wash/rinse chamber 12, through which racks of ware are intermittently moved by a conveyor mechanism (not shown) along tracks 14 between an upper wash arm 16 and a lower wash arm 18, each of which arms is conventionally supplied with a plurality of spray nozzles 20. Water is fed to the wash arms by means of a pump 22 which has a screened water intake 24 and is passed through a conduit 26 to the arms. The water intake is adjacent the bottom of a tank 28 which extends essentially the full length of the warewasher as viewed in FIG. 1. Tabling (not shown) is provided at both the left and right sides of the washer for supporting racks of ware as they are about to enter the wash chamber 12 from one side and also as they exit from the opposite side after having been cleaned. An inspection door 30 may expose the chamber 12 to an operator at the front of the machine if desired for any reason. As viewed in FIG. 2, the chamber 12 is normally closed at both the entrance and exit ends by flexible splash curtain strips (not shown).

Water 32 is normally maintained at a predetermined fill level during operation of the washer. When preliminarily filled at the start of a day, the tank 28 may be filled from either a separate heated water supply or through a conventionally-supplied fresh water rinse line. The level is maintained by a float switch (not shown) which is operated to close a fill valve when the water level reaches the point just below the top end of a hollow tubular standpipe 34. A drain 36 is provided at the bottom of the tank, and may be separate from or associated with the standpipe in accordance with the particular warewasher design. During normal operation, the water level will remain within one or two inches from the initial fill level, fluctuating within that range. As the pump operates in a wash cycle, about four of five gallons of water are suspended in the pump, conduit, wash arms and chamber as water is recirculated and drains back from the washed ware into the tank. When washing of a rack of ware is completed, the pumps shut off and the water in suspension drains back into the tank, causing overflow of excess water and floating soil through the standpipe. The rack of washed ware is then conveyed past a hot fresh water final rinse line (not shown) while the next rack of ware is being moved into the wash chamber. The rinse water replenishes the water in the wash chamber 12, also causing floating soil to enter the open top of the standpipe 34 and pass to drain. What has thus far been described is conventional in one type of warewasher and is described solely to place the invention in an environment in which it is used.

Figure 3:
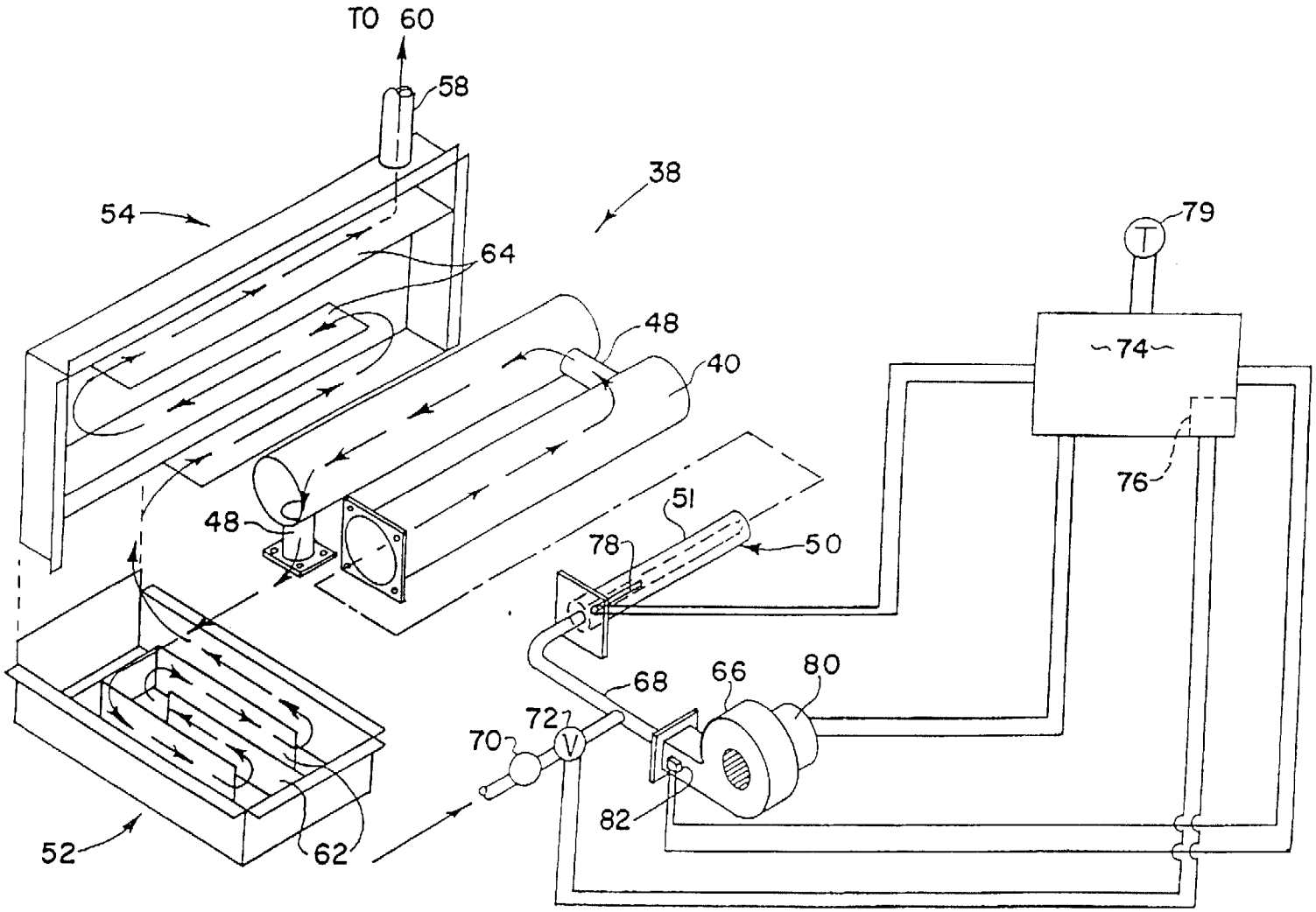
FIG. 3 is a schematic isometric view of key heating and operating elements of the preferred form of warewasher heating system.
Figure 4:
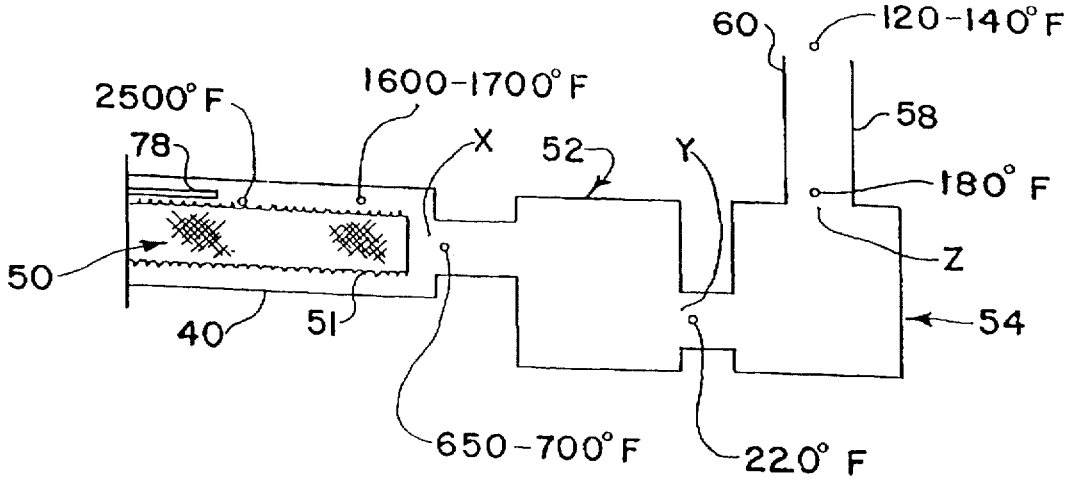
FIG. 4 is a simplified view in block diagram form for illustrating representative decreasing temperatures at certain locations along the heating system in a warewasher of the type shown in FIGS. 1 and 2.
Figure 6:
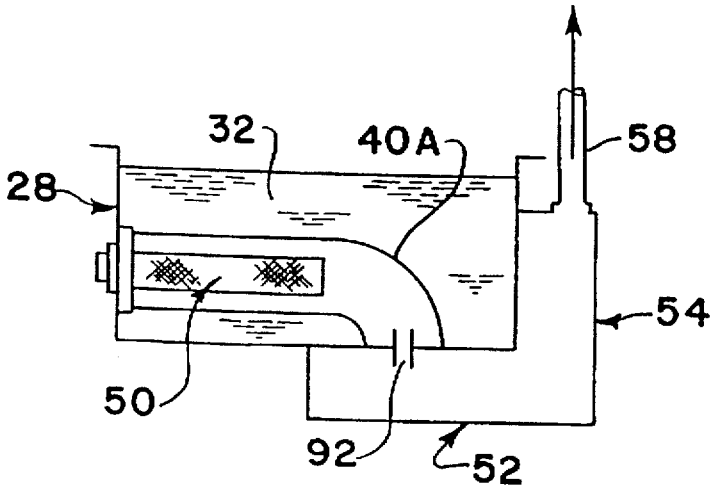
FIGS. 6–8 are simplified schematic elevational representations of other embodiments of heating systems which may be used in the tank.
Figure 7:
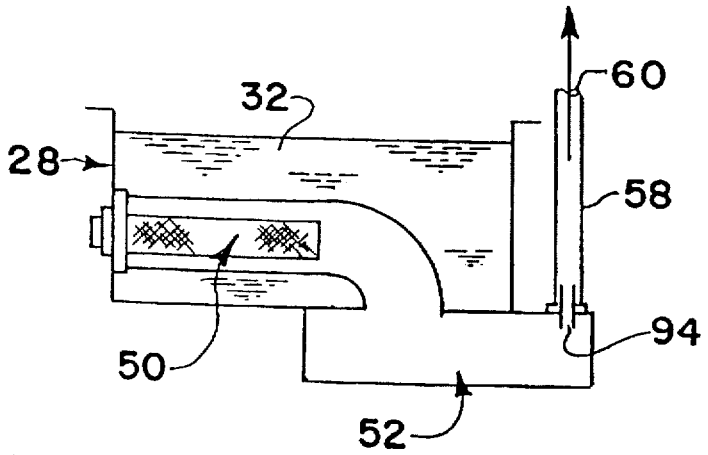
Figure 8:
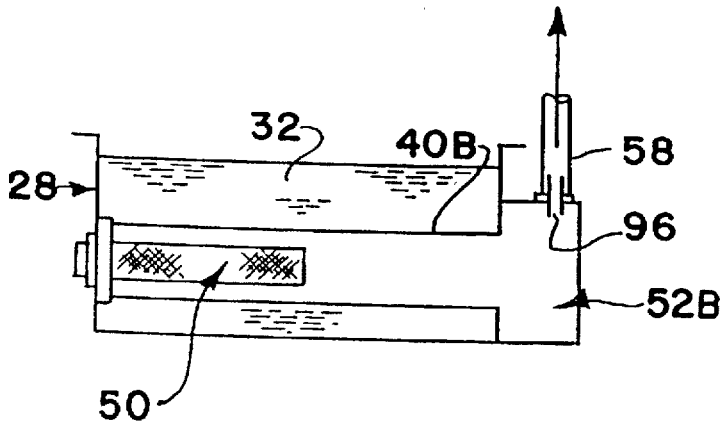

The novel features of this invention relate to a tank heating system 38 illustrated in detailed isometric and schematic fashion in FIG. 3, but also shown positionally in FIGS. 1 and 2. By cross-referring to these three Figures, it can be seen that a hollow, elongated primary heat exchange tube 40 is mounted at an inlet end to the left side wall 42 of tank 28, extends horizontally toward but short of a right side wall 44, and returns in a U-shaped configuration back toward but short of wall 42. From there, the tube 40 extends downwardly to a bottom wall 46 of the tank. The tube 40 thus provides an air/gas passageway from the inlet at the left side wall 42 to an outlet at the bottom wall 46. While this is the preferred form of the invention, the tube can be U-shaped as shown, have just a single pass instead of being U-shaped and can have the smaller diameter tube portion or portions 48 or not, as desired. Other embodiments of a tube configuration other than a U shape are illustrated in FIG. 6–8, to be described later. The smaller diameter tube portions 48 serve to induce or create a back pressure in the system, a necessity for proper and effective operation of pressurized, (i.e., non-atmospheric) IR heating systems, as will be discussed. It should be understood, also, that the back pressure can be induced anywhere in the system between a gas-fired IR burner 50 and the vented end of the heating system. Best results thus far found appear to come from creation of a back pressure restrictor close to the burner, as will be discussed in connection with FIG. 4.

The burner 50 may be of the type produced by Solaronics, Inc. of Rochester, Minn. under Model No. 621622SC. It has a hollow central permeable tube about which a sleeve of woven ceramic fabric is provided. When an air/gas mixture is introduced under pressure into the hollow tube, it flows outwardly through the interstices of the woven fabric and, upon ignition of the mixture, forms the entire outer surface of the fabric to serve as an IR combustion surface 51. When the pressure of the air/gas mixture and the back pressure built into the design are properly tuned, the flame will have a burning zone at the combustion surface 51 which is perhaps one-eighth inch high. This tuning is commonly understood in IR burners. Excessive pressure of the mixture may "blow off" the flame, i.e., elevate it above the combustion surface 51, while insufficient mixture pressure may cause flashback, with premature ignition occurring beneath the combustion surface. A balance must be struck in the design of each particular heat exchange system in order to achieve the most efficient operation and greatest heat transfer.

It is believed that most IR heat exchange systems for heating water are "closed", e.g., as in a home or commercial water heater tank. Use in a warewasher tank which is "open" to atmosphere presents some problems, such as maintaining the tank immersed at all times in a situation where the water level may fluctuate during operation, obtaining sufficient heat transfer to the water in the tank to make the system economically effective and protecting against IR operation when the tank is empty. We have been able to make heating of water in such an open tank as much as ninety-five percent thermally efficient, i.e., imparting ninety-five percent of the energy source to the water.

Maximum thermal efficiency of the invention is obtained by utilizing one or more additional heat exchangers in intimate contact with a side or sides of the tank walls and passing the combustion products exiting from the burner 50 sequentially through such additional heat exchangers en route to their ultimate venting point. In our preferred form of the invention shown in FIG. 3, a secondary heat exchanger 52 having four side walls and a bottom wall is intimately fastened to the tank bottom wall 46 at flanged upper edges with its open topside directly against the stainless steel skin of the bottom wall 46. A tertiary heat exchanger 54 similarly fastened in intimate contact to a rear side wall 56 receives combustion products from the exchanger 52, and from there the products pass upwardly through an exhaust stack 58 to an upper vented end 60. The arrows shown in FIG. 3 illustrate the path taken by the combustion products of the IR burner from the inlet end of the tube 40 to the vented end 60 of the stack 58. Baffle plates 62 and 64 extend upwardly from the bottom walls to the top edges of the heat exchangers 52 and 54, respectively. The baffle plates provide labyrinthine passageways for the gases through the secondary and tertiary heat exchangers 52 and 54 with maximum heat exchange area against their respective walls. The drawings and arrows of FIG. 3 are believed sufficiently explanatory of the effect of obtaining heat transfer from the exchangers 52 and 54 to the tank bottom and rear side walls. Obviously, only one wall heat exchanger such as 52 or 54 is capable of providing some efficiency advantage, and using two heat exchangers and locating the first in the sequence at the tank bottom wall seems to provide the greatest heat transfer. By having the secondary heat exchanger 52 on the bottom wall, convection and conduction heat transfer have their greatest effect beyond the already-significant IR radiation achieved by the primary heat exchange tube 40 directly in the water. By reference to FIG. 4, where temperature measurements have been shown at certain points along the tank heating system, it can be seen that the temperature drops off rapidly from the primary through the tertiary heat exchangers. The exit temperature at the vented end 60 of the stack is low enough to place one's hands in the air flow without any problem. At this point, emissions have been burnt off and are minimal. Where required to be vented outdoors, exterior air pollution is reduced to a level not believed possible with conventional blue flame gas-fired burners.

Operation

The operation of the tank heating system 38 is best illustrated in FIG. 3. Air flow is provided by a centrifugal fan or blower 66 to the hollow inside of IR burner 50 through a pipe or conduit 68. Gas is introduced into the conduit 68 between the blower 66 and burner 50 through a pressure regulator 70 and valve 72. The gas and air mix internally of the conduit as they merge, in conventional fashion. An orifice adjustment and/or regulator (not shown) in the gas line is the only adjustment required to balance or tune the system to make the flame reside at the proper height on the surface of the IR burner 50.

Control is simply shown in FIG. 3 as being accomplished through a control box 74 having a time delay portion 76 for determining the time of operation of the gas valve 72. Electrical controls have been simply indicated as parallel wires from the control box 74 to the various components, all of which are standard off-the-shelf purchased items of various manufacturers. To ignite the air/gas mixture at the outer combustion surface of the burner 50, a preferred form of igniter 78 manufactured by Channel Products of Chesterland, Ohio is provided adjacent the inlet end of the burner. It achieves a fast-responding, non-sparking hot surface ignition with relatively low wattage.

When the tank water temperature reaches the low end of its allowable temperature range, the tank heating system is called upon to perform its function. A thermostat 79 (FIG. 3) located in the tank water 32 operates through the control box 74 to activate a motor 80 of the blower 66, causing it to force air through the conduit 68 toward the hollow interior of the IR burner 50. An immediate pressure build-up occurs, causing an air flow sensor 82 to detect functioning of the blower 66. This triggers the controls to activate the igniter 78 to glow and prepare to ignite the air/gas mixture upon its arrival at the combustion surface 51 of the burner 50. After a short time delay (e.g., on the order of 0.7 seconds) effectuated by the time delay portion 76 of the controls, providing both the blower 66 and igniter 70 are properly functioning, the valve 72 in the gas line is caused to open, introducing gas into the conduit 68, mixing it with the air and thereupon igniting at the burner outer surface. If either the blower or igniter fails to function, the control system will shut down and inhibit operation in known fashion, and an appropriate signal of the malfunction be transmitted to the warewasher operator. Once air flow, ignition and gas flow commence properly, the IR burner 50 will provide the heat necessary to have the primary, secondary and tertiary heat exchangers perform the tasks of rapidly and efficiently heating water in the tank until the water temperature reaches the proper upper end of its range. At such time, the tank heating system 38 will shut down until required to heat the water again. Conventional controls are also provided to inhibit operation of the tank heating system if the tank has not been filled, or once having been filled, if it drains while the controls are still calling for automatic operation.

Figure 5:
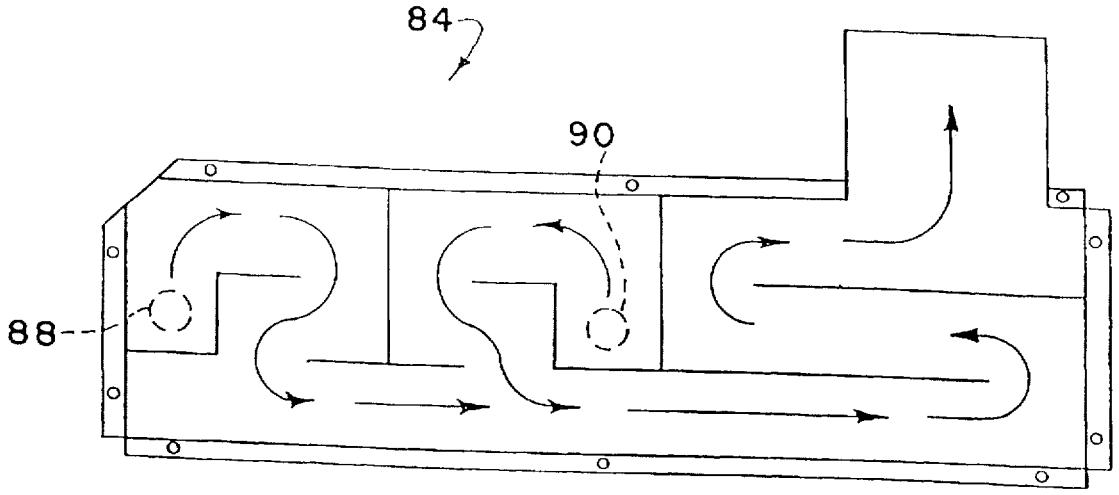
FIG. 5 is a plan view of a bottom secondary heat exchanger baffle box utilized when two independent pairs of heating tubes and IR burners are used for heating water in a single tank. When so used, separate controls are used for each system.

As stated earlier, the tube 40 may be a single tube rather than the U-shaped configuration illustrated. Additionally, for very large continuous conveyor warewashers having a large capacity water tank, two independent tank heating systems 38 may be utilized to maintain the water temperature. Each is provided with a complete set of the operating elements shown in FIG. 3. However, by using a novel design, partially-common secondary heat exchanger 84, we can gain additional heat transfer from the secondary heat exchanger as compared to utilizing two separate heat exchangers such as 52 at the tank bottom. The exchanger 84 is illustrated in FIG. 5. The numeral 88 represents the connection with the outlet end of the tube portion 48 from one system 38, while the numeral 90 represents the connection with the outlet end of the tube portion 48 of the other system. The direction of air flow arrows demonstrate that a labyrinth of about one third the area of the exchanger 84 is dedicated to each system 38, and the remaining third or so is common to both systems as the combustion products merge and flow together toward the tertiary heat exchanger or vented end of the exhaust stack. If desired, the tertiary heat exchanger may be designed like exchanger 84, maintaining air flow separate until merging in the tertiary exchanger. Space at the underside of the tank is often at a premium, and less attaching space for the flanges is required by utilizing the common heat exchanger 84 for both systems.

Various other embodiments or arrangements of heat exchangers are possible without departing from our invention. FIGS. 6–8 are exemplary.

In FIG. 6, a single curved tube 40A goes directly to the secondary heat exchanger 52. A necked down area 92 performs a back pressure-creating function performed by the smaller diameter tube 48 at the base of the U in the FIG. 3 version.

The same (but likely less efficient) function can be achieved with a version of the invention like the one shown in FIG. 7. This version is shown substantially like that of FIG. 6, but does not take advantage of a tertiary heat exchanger, since wall space on the tank is not always available on all warewashers. Back pressure may be induced by a necked-down area 94 where the secondary heat exchanger 52 connects with the exhaust stack or at the vented end 60 of the stack.

FIG. 8 shows a straight-through, single diameter heat exchange tube 40B with a secondary heat exchanger 52B being mounted on a rear or side wall of the tank 28. A back pressure-inducing necked-down area 96 may be provided at the outlet from the secondary heat exchanger or the vented end of the stack 58 for the purpose previously mentioned.

Back pressure, while preferably being created close to the IR burner to operate most efficiently, can function anywhere between the IR burner 50 and the vented end 60. It may also be feasible to obtain back pressure simply with the column of static air in the passageways throughout the system at the time of ignition, since that column must first be displaced. Friction opposing movement of the combustion gases can function to maintain the back pressure during operation. For this reason, it is contemplated that even an unrestricted flow will perform to some extent and the claims are intended to encompass such designs, provided enhanced efficiency is obtainable utilizing other aspects of of our invention.

Having described our invention, we claim:

1. In a warewasher having an enclosable wash/rinse chamber, an open-topped water tank at the bottom of said chamber, said tank having a bottom wall and side walls for containing water therein at an approximate predetermined fill level during an idle period between successive washing periods, at least one wash arm, a water pump having an inlet adjacent the bottom of said tank, and conduit means interconnecting said pump and said wash arm for recirculating water by means of said pump during a wash period from said pump inlet to said wash arm onto ware in said chamber and enabling returning of the water to said tank through said open top during water recirculation, the improvement including a tank heating system for maintaining water temperature within a predetermined elevated range, comprising:

a hollow, elongated heat exchange tube immersed in water in said tank a distance below said fill level and below a level to which water descends while being recirculated by said pump during a wash period, said heat exchange tube having an outer surface in primary heat exchange relationship with water in said tank;

said heat exchange tube extending between a pair of walls of said tank and having an inlet end and an outlet end to provide a passageway for conducting an air/gas fuel mixture through said heat exchange tube;

a hollow, elongated infrared gas burner positioned generally centrally within said heat exchange tube and mounted adjacent the inlet end of said tube, said burner including a permeable outer combustion surface spaced a short distance from the internal surface of said hollow tube and providing a shallow burning zone at said permeable outer surface;

an igniter closely adjacent the combustion surface of said burner essentially at said inlet end of said heat exchange tube;

an air blower including an air conducting conduit for inducing air to flow into said hollow burner and through said combustion surface when said blower is activated;

water temperature sensing means in said tank for activating said air blower in response to the water temperature decreasing below said predetermined temperature range;

air flow sensing means associated with said air conducting conduit for activating said igniter to an igniting condition in response to activation of said air blower;

a gas supply including a supply line connected to said conduit intermediate said blower and said burner;

valve means in said supply line for connecting and disconnecting said gas supply relative to said conduit;

control means for activating said valve means to an open gas flow condition in response to activation of said air blower and said igniter;

said air flow and gas providing an ignitable air/gas mixture to said burner for combustion of said mixture at said burning zone by means of said igniter;

at least one secondary heat exchanger in intimate contact with the exterior of at least one wall of said tank below said predetermined fill level;

an exhaust stack for venting combustion products to the exterior of said warewasher;

said secondary heat exchanger having baffle means therein forming a labyrinthine passageway communicating at one end thereof with the outlet end of said primary heat exchanger and at the opposite end thereof with an entrance end of said exhaust stack; and means intermediate said combustion outer surface and the vented end of the exhaust stack for inducing sufficient back pressure within said heat exchangers to maximize heat transfer from said water heating system to water within the tank.

2. A warewasher according to claim 1 wherein said igniter is electrically operated to a constant ignition glow condition when activated, and wherein said control means includes time delay means for activating said gas valve means after a predetermined activation period of said igniter.

3. A warewasher according to claim 2 wherein said control means is provided with means to inhibit activation of said valve means in the event said igniter fails to activate when required.

4. A warewasher according to claim 1 wherein a tertiary heat exchanger having baffle means therein creating a labyrinthine passageway is provided intermediate and is in series air flow connection with said secondary heat exchanger and said exhaust stack, said tertiary heat exchanger being in intimate heat exchange contact with one of said tank walls below said predetermined fill level.

5. A warewasher according to claim 4 wherein said back pressure inducing means comprises an air flow restrictor intermediate said secondary and tertiary heat exchangers.

6. A warewasher according to claim 4 wherein said secondary and tertiary heat exchangers are in intimate contact with different walls of said tank.

7. A warewasher according to claim 6 wherein said secondary heat exchanger is in contact with said bottom wall and said tertiary heat exchanger is in contact with a side wall other than the side wall containing the inlet end of said heat exchange tube.

8. A warewasher according to claim 1 wherein said back pressure inducing means comprises a reduced-diameter portion of said heat exchange tube.

9. A warewasher according to claim 1 wherein said back pressure inducing means comprises an air flow restrictor intermediate the outlet end of the heat exchange tube and the secondary heat exchanger.

10. A warewasher according to claim 1 wherein said back pressure inducing means comprises an air flow restrictor associated with said exhaust stack.

11. A warewasher according to claim 1 wherein said heat exchange tube comprises a horizontal, generally U-shaped configuration extending from said tube inlet at one side wall across said tank and back toward said one side wall, said tube further including a downwardly-extending end portion adjacent said one side wall and terminating at the outlet end of said tube at said bottom wall, and wherein said secondary heat exchanger is in contact with said bottom wall.

12. A warewasher according to claim 11 wherein said means for inducing a back pressure comprises the base of the U-shaped configuration, said base being of smaller cross-sectional size than the remainder of said heat exchange tube.

13. A warewasher according to claim 1 wherein each said igniter is electrically operated to a constant ignition glow condition when activated, and wherein said control means includes a time delay means for activating the respective said gas valve means after a predetermined activation period of each igniter.

14. In a warewasher having an enclosable wash/rinse chamber, an open-topped water tank at the bottom of said chamber, said tank having a bottom wall and side walls for containing water therein at an approximate predetermined fill level during an idle period between successive washing periods, at least one wash arm, a water pump having an inlet adjacent the bottom of said tank, and conduit means interconnecting said pump and said wash arm for recirculating water by means of said pump during a wash period from said pump inlet to said wash arm onto ware in said chamber and enabling returning of the water to said tank through said open top during water recirculation, the improvement including;

a). a pair of independently-operable tank heating systems for maintaining water temperature within a predetermined elevated range, each said tank heating system comprising:

i). a hollow, elongated heat exchange tube immersed in water in said tank a distance below said fill level and below a level to which water descends while being recirculated by said pump during a wash period, said heat exchange tube having an outer surface in primary heat exchange relationship with water in said tank;

ii). said heat exchange tube extending between a pair of walls of said tank and having an inlet end and an outlet end to provide a passageway for conducting an air/gas fuel mixture through said heat exchange tube;

iii). a hollow, elongated infrared gas burner positioned generally centrally within said heat exchange tube and mounted adjacent the inlet end of said tube, said burner including a permeable outer combustion surface spaced a short distance from the internal surface of said hollow tube and providing a shallow burning zone at said permeable outer surface;

iv). an igniter closely adjacent the combustion surface of said burner essentially at said inlet end of said heat exchange tube;

v). an air blower including an air conducting conduit for inducing air to flow into said hollow burner and through said combustion surface when said blower is activated;

b). water temperature sensing means in said tank for activating both said air blowers in response to the water temperature decreasing below said predetermined temperature range;

c). air flow sensing means associated with each said air conducting conduit for activating its respective said igniter to an igniting condition in response to an air pressure build-up in the respective said conduit;

d). a gas supply including a supply line connected to each said conduit intermediate its respective said blower and burner;

e). valve means in each said supply line for connecting and disconnecting its respective said gas supply relative to its said conduit;

f). control means for activating each said valve means to an open gas flow condition in response to activation of its respective said air blower and igniter;

said air flow and gas providing an ignitable air/gas mixture to each said burner for combustion of said mixture at said burning zone by means of its respective said igniter;

g). at least one secondary heat exchanger in intimate contact with the exterior of at least one wall of said tank below said predetermined fill level; said secondary heat exchanger having baffle means therein forming a pair of independent labyrinthine passageways, with a first passageway communicating at an inlet end thereof with the outlet end of one of said primary heat exchangers, a second passageway communicating at an inlet end thereof with the outlet end of the other of said primary heat exchangers, and a common outlet for both said passageways;

h). an exhaust stack for venting combustion products to the exterior of said warewasher, said exhaust stack communicating with the common outlet of said secondary heat exchanger; and i). means intermediate said combustion surface of each said burner and its respective exhaust stack vented end for inducing sufficient back pressure within said heat exchangers to maximize heat transfer from said water heating systems to water within the tank.

15. A warewasher according to claim 13 wherein a tertiary heat exchanger is provided in series air flow connection with and between the common outlet end of said secondary heat exchanger and an inlet end of said exhaust stack.

16. In a warewasher having an enclosable wash/rinse chamber, an open-topped water tank at the bottom of said chamber, said tank having a bottom wall and side walls for containing water therein at an approximate predetermined fill level during an idle period between successive washing periods, at least one wash arm, a water pump having an inlet adjacent the bottom of said tank, and conduit means interconnecting said pump and said wash arm for recirculating water by means of said pump during a wash period from said pump inlet to said wash arm onto ware in said chamber and enabling returning of the water to said tank through said open top during water recirculation, the improvement including a tank heating system for maintaining water temperature within a predetermined elevated range, comprising:

a hollow, elongated heat exchange tube immersed in water in said tank a distance below said fill level and below a level to which water descends while being recirculated by said pump during a wash period, said heat exchange tube having an outer surface in primary heat exchange relationship with water in said tank;

said heat exchange tube extending between a pair of walls of said tank and having an inlet end and an outlet end to provide a passageway for conducting an air/gas fuel mixture through said heat exchange tube;

a hollow, elongated infrared gas burner positioned generally centrally within said heat exchange tube and mounted adjacent the inlet end of said tube, said burner including a permeable outer combustion surface spaced a short distance from the internal surface of said hollow tube and providing a shallow burning zone at said permeable outer surface;

an igniter closely adjacent the combustion surface of said burner essentially at said inlet end of said heat exchange tube;

an air blower including an air conducting conduit for inducing air to flow into said hollow burner and through said combustion surface when said blower is activated;

water temperature sensing means in said tank for initiating activation of said air blower and igniter in response to the water temperature decreasing below said predetermined temperature range;

a gas supply including a supply line connected to said conduit intermediate said blower and said burner;

valve means in said supply line for connecting and disconnecting said gas supply relative to said conduit;

control means for activating said valve means to an open gas flow condition in response to activation of both said air blower and said igniter;

said air flow and gas providing an ignitable air/gas mixture to said burner for combustion of said mixture at said burning zone by means of said igniter;

at least one secondary heat exchanger in intimate contact with the exterior of at least one wall of said tank below said predetermined fill level;

an exhaust stack for venting combustion products to the exterior of said warewasher;

said secondary heat exchanger having baffle means therein forming a labyrinthine passageway communicating at one end thereof with the outlet end of said primary heat exchanger and at the opposite end thereof with an entrance end of said exhaust stack; and means intermediate said combustion outer surface and the vented end of the exhaust stack for inducing sufficient back pressure within said heat exchangers to maximize heat transfer from said water heating system to water within the tank.

17. A warewasher according to claim 16 wherein said igniter is electrically operated to a constant ignition glow condition when activated, and wherein said control means includes time delay means for activating said gas valve means after a predetermined activation period of said igniter.

18. A warewasher according to claim 16 wherein a tertiary heat exchanger having baffle means therein creating a labyrinthine passageway is provided intermediate and is in series air flow connection with said secondary heat exchanger and said exhaust stack, said tertiary heat exchanger being in intimate heat exchange contact with one of said tank walls below said predetermined fill level.

19. A warewasher according to claim 18 wherein said secondary-heat exchanger is in contact with said bottom wall and said tertiary heat exchanger is in contact with a side wall other than the side wall containing the inlet end of said heat exchange tube.

20. A warewasher according to claim 16 wherein said heat exchange tube comprises a horizontal, generally U-shaped configuration extending from said tube inlet at one side wall across said tank and back toward said one side wall, said tube further including a downwardly-extending end portion adjacent said one side wall and terminating at the outlet end of said tube at said bottom wall, and wherein said secondary heat exchanger is in contact with said bottom wall.

21. A warewasher according to claim 20 wherein a pair of independent heat exchange tubes are provided in said tank, and wherein said secondary heat exchanger comprises a portion consisting of a separate labyrinthine passageway for each of said tubes, which separate passageways merge into a second portion consisting of common passageway for outward flow of combustion products adjacent the outlet end of said secondary heat exchanger.

* * * * *

UNITED STATES PATENT AND TRADEMARK OFFICE

CERTIFICATE OF CORRECTION

PATENT NO. : 5,794,634

DATED : August 18, 1998

INVENTOR(S) : Lars Noren et al.

It is certified that error appears in the above-identified patent and that said Letters Patent is hereby corrected as shown below:

Delete claims 1-21 and insert therefor new claim 1 as follows:

--1. A warewasher comprising a wash chamber, a tank at the bottom of said wash chamber for supplying heated water to said wash chamber, a heat exchange tube entering said tank through a first port in said tank traversing the base of said tank and exiting said tank through a second port, said tube having a U-shape or a serpentine shape and being at a height such that said tube is submerged when said tank is filled with water, said tube having a first end and a second end located outside of said tank, a gas-fired infrared burner located in said tube adjacent said first end to which a combustible fuel is supplied and combusted by said burner, a baffle box including a first portion underlying said tank and a second portion adjacent one side of said tank, the combustion products of said fuel being received in said tube and vented at said second end into said baffle box, wherein by combusting fuel and passing said combustion products through said

UNITED STATES PATENT AND TRADEMARK OFFICE

CERTIFICATE OF CORRECTION

PATENT NO. : 5,794,634

DATED : August 18, 1998

INVENTOR(S) : Lars Noren et al.

It is certified that error appears in the above-identified patent and that said Letters Patent is hereby corrected as shown below:

tube and said baffle box, water in said tank is heated.—

Signed and Sealed this

Twelfth Day of January, 1999

*Attest:*

*Attesting Officer*

*Acting Commissioner of Patents and Trademarks*

US005794634B1

REEXAMINATION CERTIFICATE (4065th)

United States Patent [19] [11] B1 5,794,634

Noren et al. [45] Certificate Issued Apr. 25, 2000

[54] WAREWASHER TANK HEATING SYSTEM AND CONTROLS THEREFOR

[75] Inventors: Lars Noren; Doug Noren, both of Petaluma, Calif.

[73] Assignee: The Stero Company, Petaluma, Calif.

Reexamination Request:
No. 90/005,354, May 10, 1999

Reexamination Certificate for:

| | |
|---|---|
| Patent No.: | **5,794,634** |
| Issued: | **Aug. 18, 1998** |
| Appl. No.: | **08/883,239** |
| Filed: | **Jun. 26, 1997** |

Certificate of Correction issued Jan. 12, 1999.

Related U.S. Application Data

[63] Continuation of application No. 08/607,091, Feb. 28, 1996, Pat. No. 5,642,742, which is a continuation-in-part of application No. 08/322,929, Oct. 13, 1994, Pat. No. 5,511,570.

[51] Int. Cl.[7] ..... B08B 3/10

[52] U.S. Cl. ..... 134/57 D; 134/106; 134/108; 134/105

[58] Field of Search ..... 134/56 R, 56 D, 134/57 R, 57 D, 58 R, 58 D, 111, 105, 106, 108, 113; 165/904, 148; 431/328, 329

[56] References Cited

U.S. PATENT DOCUMENTS 3,625,233 12/1971 Southard ..... 134/165
4,900,245 2/1990 Ahmady .
5,165,887 11/1992 Ahmady .

OTHER PUBLICATIONS

Brochure entitled "Hobart C–Line Gas–Heated Warewashers", Dec. 1992.
Hobart Schematic, "Gas C–Lines," Dec. 21, 1992.
"Hobart Catalog of Replacement Parts: Model C44A & AW Series Dishwashers," Mar. 1992.

*Primary Examiner*—Frankie L. Stinson

[57] ABSTRACT

The invention includes a warewasher comprising a wash chamber, a tank at the bottom of said chamber for supplying recirculated heated water through a pump to wash arms in said chamber, a primary water heating system comprising a heat exchange tube entering said tank through a first port or inlet in said tank, traversing the base of the tank, and exiting said tank through a second port or outlet, said tube being at a height in said tank such that the tube is submerged when said tank is filled with water, said tube having a first end and a second end located outside of the tank and providing a passageway between the ends, a gas-fired infrared burner located in said tube adjacent said first end to which an air/gas mixture is supplied and combusted by said burner, at least one secondary labyrinthine heat exchanger in intimate heat transfer relationship with at least one of the walls of said tank below the water level, and controls for automatically operating the heating system in response to a need to increase the tank water temperature, the combustion products of said burner being passed through said tube and secondary heat exchanger wherein, by combusting fuel with an infrared burner to minimize air pollution and by utilizing heat exchangers in the manner discussed herein, maximum heat transfer with minimal air pollution are achieved.

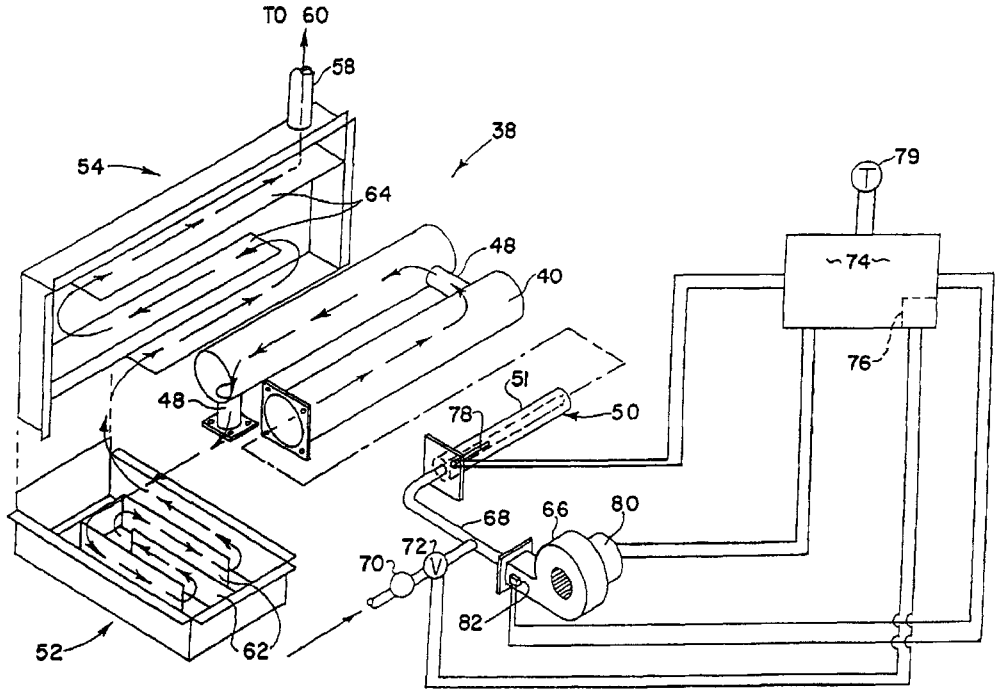

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 1 is confirmed.

* * * * *